United States Patent [19]

Herrington

[11] Patent Number: 4,666,423

[45] Date of Patent: May 19, 1987

[54] METHOD OF ALIGNING FASTENER ELEMENTS ON A FOLDED WEB AND DEVICE FOR IMPLEMENTING THE METHOD

[75] Inventor: Fox J. Herrington, Holcomb, N.Y.

[73] Assignee: Mobil Oil Corporation, New York, N.Y.

[21] Appl. No.: 798,514

[22] Filed: Nov. 15, 1985

[51] Int. Cl.[4] ..... B31B 23/36; B31B 23/60

[52] U.S. Cl. ..... 493/394; 493/248; 493/390; 493/439

[58] Field of Search ..... 493/212, 213, 214, 394, 493/417, 439, 466, 468, 476, 248; 425/326.1; 264/40.3

[56] References Cited

U.S. PATENT DOCUMENTS

| | | | |
|---|---|---|---|
| Re. 26,991 | 11/1970 | Luca | 264/519 |
| Re. 28,959 | 9/1976 | Naito | 425/326.1 |
| 281,619 | 7/1883 | Crowell | 493/439 |
| 3,147,008 | 9/1964 | Singleton | 493/439 |
| 4,091,595 | 5/1978 | Pelster et al. | 53/14 |
| 4,355,494 | 10/1982 | Tilman | 53/416 |

*Primary Examiner*—Frederick R. Schmidt
*Assistant Examiner*—William E. Terrell
*Attorney, Agent, or Firm*—Alexander J. McKillop; Michael G. Gilman; Charles J. Speciale

[57] ABSTRACT

A method of folding a continuous web of a thermoplastic film material incorporating complementary interengagable profiled fastener elements, and aligning and interengaging the complementary fastener elements. Moreover, also provided is a device over which the web of thermoplastic film material is folded, with the device possessing structure for superimposing and aligning the fastener elements and interengaging the fastener elements which are adapted to be utilized in the production of reclosable plastic bags.

8 Claims, 9 Drawing Figures

METHOD OF ALIGNING FASTENER ELEMENTS ON A FOLDED WEB AND DEVICE FOR IMPLEMENTING THE METHOD

BACKGROUND OF THE INVENTION

1. Field of the Invention

The present invention relates to a method of folding a continuous web of a thermoplastic film material incorporating complementary interengagable profiled fastener elements, and aligning and interengaging the complementary fastener elements. Moreover, the invention relates to a device over which the web of thermoplastic film material is folded, with the device possessing structure for superimposing and aligning the fastener elements and interengaging the fastener elements which are adapted to be utilized in the production of reclosable plastic bags.

Basically, plastic bags which are produced from an extruded thermoplastic film web material, and which bags incorporate resealable closures, such as interengagable fastener elements forming such closures to provide hermetically sealed bags which, subsequent to being opened by separating the interengaged fastener elements, are then reclosable by again engaging the fastener elements, are widely known in the art, and have gained widespread consumer acceptance.

Thus, an extensive variety of products can be readily packaged and stored under widely ranging temperature conditions in such plastic bags, ranging from food items which are adapted to be frozen and/or stored for lengthy periods of times, to hardware, soft goods, and sundry types of materials in either a fluid, solid, or granular-pulverulent state.

Generally, such plastic bags are formed from continuous webs of extruded thermoplastic materials in which complementary fastener elements are integrally coextruded with or attached to the film, with the film then being folded in order to align the fastener elements in a superimposed relationship and with the elements thereafter being interengaged. Subsequently, lateral seals extending transverse of the direction of advance or machine direction of the film web are imparted at predetermined intervals to the folded film, and the film is cut into individual sections, or weakening lines are formed in the regions of such lateral seals in order to form the folded web into individual thermoplastic bags which are either separated or attached to each other along the weakening lines, which may be either perforations, serrations, slits, or score lines in the film.

A major problem which is encountered in the folding of such thermoplastic film material possessing complementary profiled fastener elements for the formation of plastic bags resides in implementing the precise aligning of the fastener elements during the advance of the web at the relatively high production speeds which are necessary for an economical manufacture of such bags.

In order to achieve a maximum production rate for such reclosable thermoplastic bags which are formed from a folded continuous web of a thermoplastic film incorporating complementary interengagable and repeatedly openable fastener elements, it is essential that during the folding of the film web there is effected the precisely aligned superposition between the components of the complementary fastener elements, so as to enable them to be interengaged through the application of external pressure to the film web as the latter is advanced in the machine direction.

2. Discussion of the Prior Art

At this time, the needs of industry in developing methods and devices for aligning and interengaging continuous fastener elements formed on extruded thermoplastic film web material, such as for plastic bags, have not been fully addressed in the technology relating to the high speed formation of reclosable plastic bags constituted of thermoplastic film material.

Thus, Ausnit U.S. Pat. No. 4,196,030 discloses a method for producing extruded thermoplastic bags, wherein a relatively complex manufacturing procedure is employed for folding the thermoplastic film and interengaging male and female profiled fastener elements which form reclosable closures for the film bags, such elements being integral protuberances formed on the film web surface during extrusion of the film.

Zygan, et al. U.S. Pat. No. 3,240,412 discloses an arrangement for handling tensioned webs of foil possessing flanged edges, in which the flanged edges are passed through a clamping device providing a gap sufficiently wide to allow the foil or web to pass therethrough while maintaining the flanged structure on the web in a clamped relationship to allow for appropriate tensioning of the foil web.

Hawley U.S. Pat. No. 3,579,747 discloses a plastic film sheeting having stripping of profiled male and female fastener elements molded along the longitudinal edges thereof. The fastener elements are adapted to be interengaged through the action of an aligning slide fastener block through the openings of which the male and female fastener members are aligned and thereafter interengaged to form a closed fastener arrangement.

Sanborn, Jr. U.S. Pat. No. 4,240,241 discloses a method and apparatus for producing a reclosable package, such as a package constituted of a thermoplastic material in which pressure is applied to cause the interengagement of profiled fastener elements formed on plastic film or package structure.

However, none of the prior art disclosures relate to the folding of thermoplastic film webs in a predetermined manner to align profiled fastener elements formed thereon as the film is conducted at a high rate of speed over a folding apparatus which will align the fastener elements for interengagement thereof.

In essence, the current state of the technology does not make any adequate provision for properly aligning the complementary components of a zipper or continuous profiled fastener elements formed on a thermoplastic film web material which, in particular, is adapted for the production of plastic bags having reclosable openings formed by the fastener elements.

SUMMARY OF THE INVENTION

Pursuant to the present invention, a continuous web of a thermoplastic film material having complementary profiled fastener elements attached or formed thereon and extending in the machine direction of the web, is adapted to be folded so as to extend along the opposite sides of a folding and aligning block incorporating structure for aligning the complementary components of the fastener elements advancing along the opposite surfaces to be brought into a precise superimposed relationship so as to be latchingly interengaged through the application of pressure by being conveyed between counter-rotatable nip rolls.

Thus, pursuant to the present invention, a continuous web of an extruded thermoplastic film material possessing continuous stripping of profiled fastener elements extending along the longitudinal axis or machine direction of the film is folded over the opposite conveying surfaces of a triangular folding block such that the fastener elements face towards the surfaces. The opposite surfaces are provided with recesses or grooves for receiving the respective mating components of the profiled fastener elements, such as to thereby align the components of the fastener elements relative to each other in a precisely oriented superimposed relationship upon the folded film web leaving the folding block. In order to maintain the components of the fastener elements in their respective grooves on the triangular folding block, thereby ensuring their alignment, suitable clamping blocks are fastened to the block so as to extend along the surfaces containing the grooves, and forming gaps with the surfaces sufficiently wide to enable the thermoplastic film to pass therethrough, but narrow enough to prevent the fastener elements from slipping out from the respective grooves in the opposite surfaces of the triangular block.

Upon the superimposed fastener elements leaving the folding block in their aligned position, which is due to the arrangement and location of the grooves in the opposite surfaces of the folding block and the joining at the bottom end thereof, external pressure is applied to the fastener elements, such as passing the folded web between a pair of rotating nip rolls, whereby the pressure causes the fastener elements to interengage and to essentially form a closed (but reopenable) fastener or seal structure. Thereafter, the folded thermoplastic film with the fastener elements being in interengagement, in effect, a flattened tubular structure in transverse cross-section, is conducted towards a suitable apparatus for producing the transverse heat seals and to form a series of reclosable thermoplastic bags, as is described hereinabove.

Accordingly, it is an object of the present invention to provide a method of folding a web of a thermoplastic film material incorporating complementary fastener element components, and aligning the components of the fastener elements for ready interengagement.

Another object of the invention resides in the provision of a novel aligning block structure for accurately aligning profiled fastener elements on a folded thermoplastic film web, and interengaging the fastener elements to form closures for plastic bags.

BRIEF DESCRIPTION OF THE DRAWINGS

Reference may now be had to the following detailed description of an exemplary embodiment of the invention for the folding of thermoplastic film material having complementary fastener elements thereon, and for the aligned superposition of the components of the fastener elements to enable them to be interengaged in an efficient and rapid mode, taken in conjunction with the accompanying drawings; in which.

DETAILED DESCRIPTION

Figure 1:
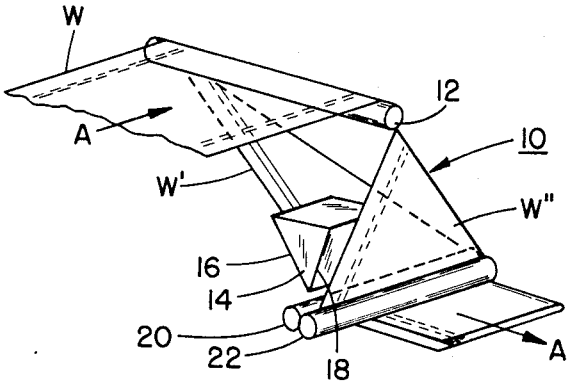
FIG. 1 schematically illustrates a device for the folding web of a thermoplastic film material and for aligning and superimposing complementary fastener elements formed thereon.

Referring in detail to the drawings, and particularly FIG. 1 which generally schematically illustrates an arrangement 10 for the folding of a layflat web of an extruded thermoplastic material, and aligning and superimposing profiled fastener elements formed on the film web.

A web W of a thermoplastic film material having strippings of complementary fastener elements formed thereon is conveyed over a feed roller 12 along the direction of arrow A, preferably continuously advancing in the machine direction of the web.

As the film web W is conveyed over the feed roller 12, it is folded into surface portions W′ and W″ so as to extend over a substantially triangular aligner block 14, with the facing surfaces of the folded film web being in surface contact with the opposite converging side surfaces 16 and 18 of the aligner block 14.

Figure 8:
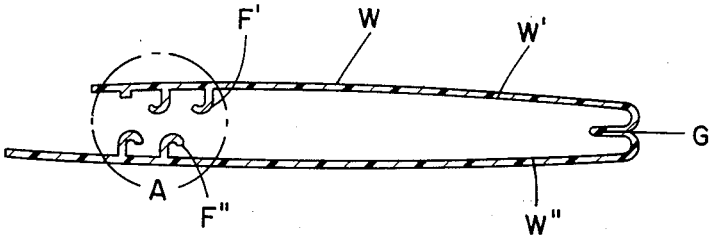
FIGS. 8 and 8*a* illustrate, respectively on enlarged scales, the folded film web and the details of the complementary profiled fastener elements on the thermoplastic film web.
Figure 8A:
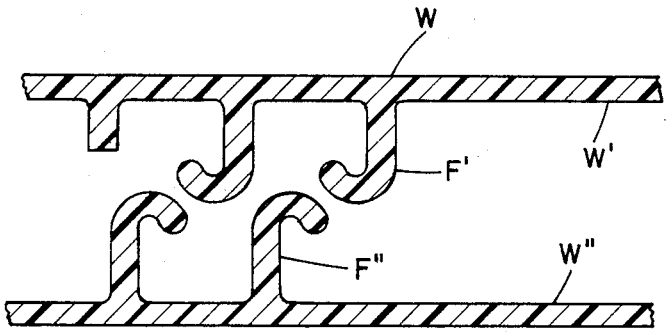

The thermoplastic film web W, as shown on enlarged scales in FIGS. 8 and 8A, is provided with continuous strippings of complementary profiled fastener elements F′ and F″, which are either integrally formed with the film web W or heat or adhesive bonded thereto, and which extend in spaced relationship along the longitudinal axis of the web W in the machine direction thereof whereby, upon folding of the web W, the fastener elements F′, F″ face each other as shown in FIGS. 8 and 8*a*. The fastener elements, which are of a somewhat heavier and consequently more rigid construction than the relatively thin flexible thermoplastic film web W, may be in the shape of resiliently or pliably interengagable hooks or the like, which can be readily pulled apart, as is well known in the technology relating to molded reclosable thermoplastic fastener elements, such as are employed on plastic bags, and need not be described in further detail herein.

As the mutually facing fastener elements F′, F″ on the folded web surfaces W′ and W″ are aligned and then superimposed at the lower apex formed by the converging surfaces 16, 18 of the triangular aligner block 14, the film web is conveyed between a pair of counter-rotating nip rolls 20, 22, which are subjected to compressive forces tending to bias the rolls together, as is detailed hereinbelow. The compressive action exerted by the nip rolls 20, 22 against the superimposed fastener elements F′, F″ will cause the hook portions on the complementary fastener elements to interengage, thereby effectively forming a closed or sealed flattened tubular structure from the film W after passing between the nip rolls. If desired, the end of the folded film web W which is distant from the fastener elements F′, F″, may be provided with an inwardly folded gusset G as is well known in the forming of gussetted plastic bags or sacks. Thereafter, the flattened end folded film web W, with the fastener elements F′, F″ being in an interengaged condition, may have transverse seals imparted thereto at predetermined spacings, and cut into separate bag unit through the seals, or alternatively formed into a series of contiguously attached bags which may be readily separated from each other through the formation of either weakening score lines, slits, perforations or serrations extending through the transverse seals, as is well known in the art.

It is an important aspect of the present invention that the profiled complementary fastener elements F', F'' be brought into precise alignment and superposition with each other subsequent to the folding of the web W in order to enable the fastener elements to be readily interengaged upon being conveyed through the bite between the nip rolls 20, 22.

In order to attain the foregoing, the structure of the inventive arrangement, which incorporates the aligner block 14 for the fastener elements F', F'' is shown in further detail in FIGS. 2 through 7 of the drawings, as described hereinbelow.

A stationary frame assembly 30 possesses suitable support structure, such as horizontal beams and upright members, which are not described in detail, and at the upper end of which there is rotatably journaled the feed roller 12, over which there is conducted the layflat film web W along the direction of arrow A, as also shown in FIG. 1. The film web W may be supplied either directly from an extruder (not shown), or from a supply source such as a roll of the film material. The profiled fastener elements F', F'' may be integrally molded into or extruded with the film web W as continuous stripping extending along the machine direction of the film. Alternatively, the fastener elements may be applied to the film web after extruding, such as by adhesive or heat bonding.

The film web W is then conducted downwardly and concurrently folded such that the folded sides W', W'' of the film facing towards each other will, respectively, slide along and in surface contact with the opposite converging surfaces 16, 18 of the triangular aligner block 14, towards the lower apex or juncture between these surfaces. The arrangement of the profiled fastener elements F', F'' extending along each of the respective folded sides W', W'' of the web W is such as to face towards each other and towards the respective converging surface 16, 18 of the aligner block 14.

In order to ensure that the profiled fastener element components F', F'' are in complete alignment and superposition as they leave the aligner block 14 and are conducted into the nip or bite between the nip rolls 20, 22, each of the surfaces 16, 18 of the triangular aligner block 14, which is respectively contacted by the folded film web portion W', W'', is provided with a downwardly extending elongate groove 32 which is dimensioned so as to be able to receive the applicable fastener element F', F'' on the side of the folded film web portion W' or W'' traveling along the applicable surface 16 or 18 of the aligner block 14.

Figure 7:
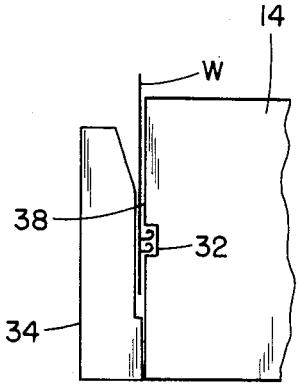
FIG. 7 illustrates an enlarged fragmentary section taken along line 7—7 in FIG. 6.
Figure 4:
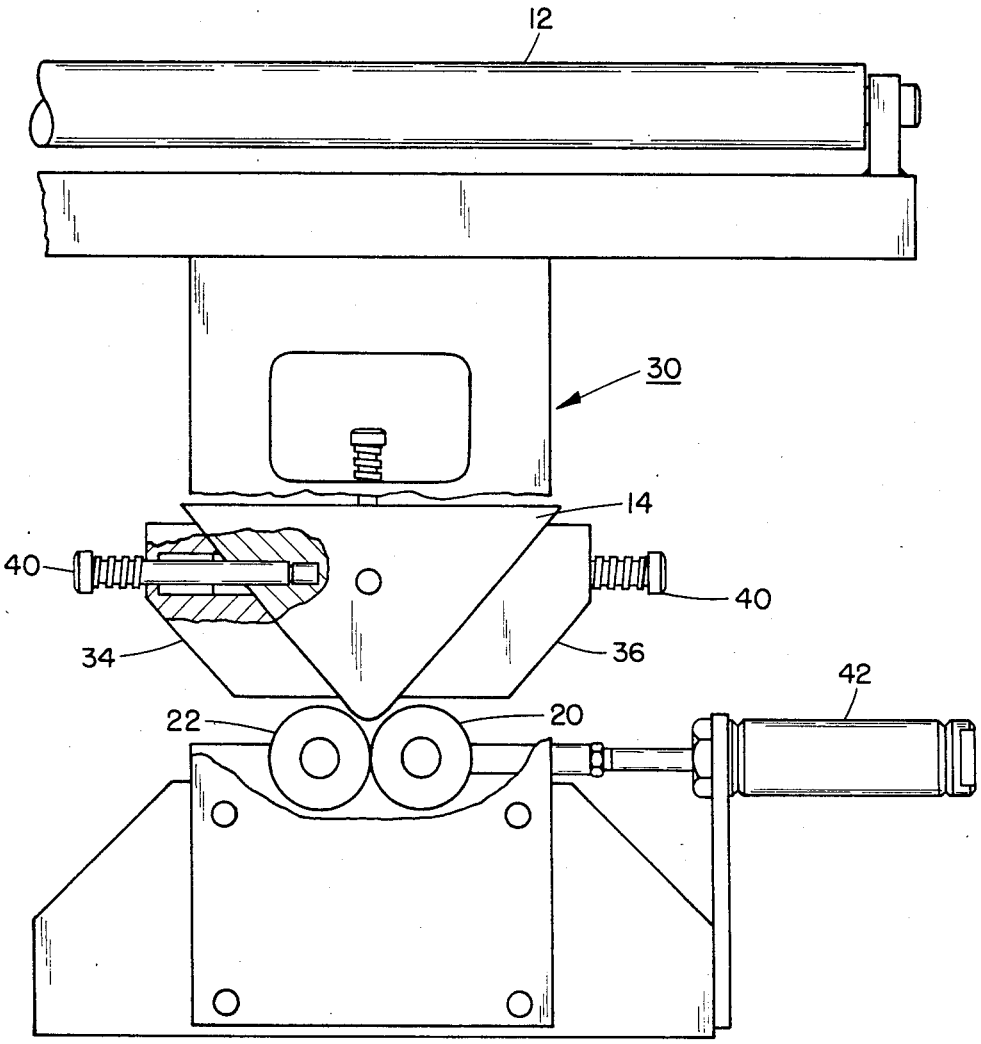
FIG. 4 illustrates an opposite side elevational view.
Figure 5:
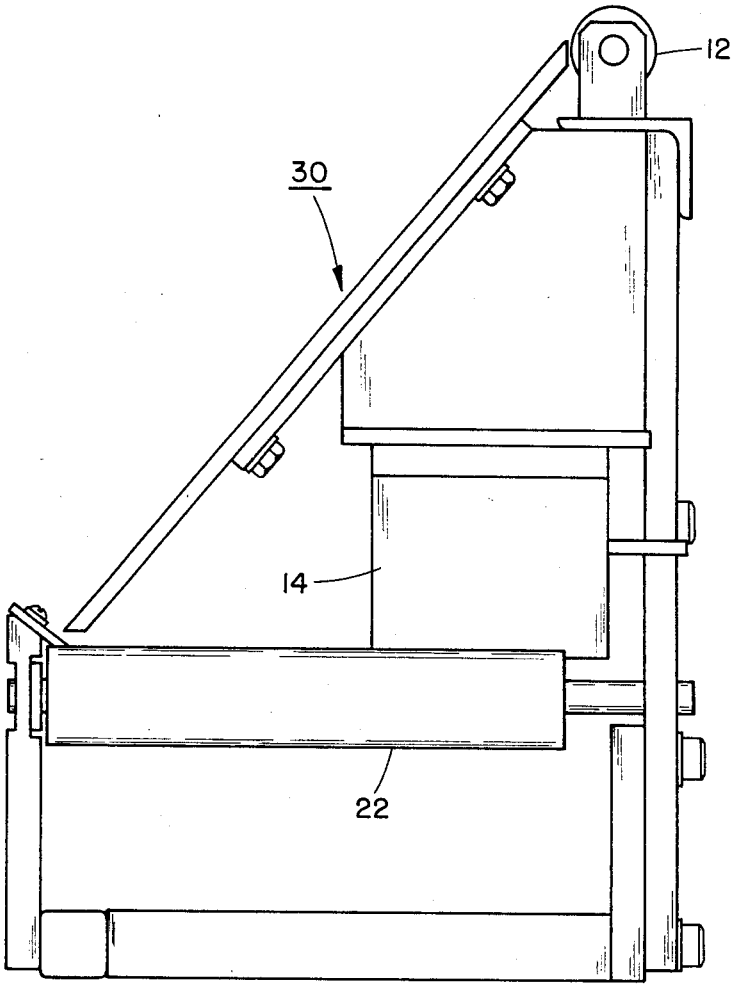
FIG. 5 illustrates a front elevational view of the device.

As shown in FIG. 4, a clamping block 34, 36 is fastened to, respectively, each of the surfaces 16 and 18 of the aligner block 14, such that the surface of each block 34, 36 facing the surfaces 16, 18 is machined to provide a step which forms a narrow gap 38, for example, in the magnitude of about 0.015 inch, therewith along its length, of a width permitting the body of the film web portions W', W'' to travel through the gap 38 between each clamping block and adjacent surfaces 16 or 18 of the aligner block 14, but with the gap being sufficiently narrow, as shown in FIG. 7, to prevent the fastener elements F', F'' from leaving the respective groove 32 in the surfaces 16 or 18 within which they are conducted during the travel of the film web W downwardly within the gap 38 between the surfaces 16 or 18 of the aligner block 14 and the associated clamping block 34 or 36. As indicated, this will ensure that each film web section W' or W'' can be readily conducted through the gap 38 along the contacting surfaces 16 or 18 of the aligner block 14, and concurrently ensure that the fastener elements F', F'' will be retained within each applicable associated groove 32 as the film web travels downwardly towards the nip rolls 20, 22. Suitable spring-biased fastener elements 40 for securing the respective clamping blocks 34, 36 to the aligner block 14 will ensure that each clamping block maintains the appropriate gap spacing between the aligner block surfaces 16 and 18 along which each film section W', W'' is traveling and the facing surface on each of the clamping blocks 34, 36.

Figure 6:
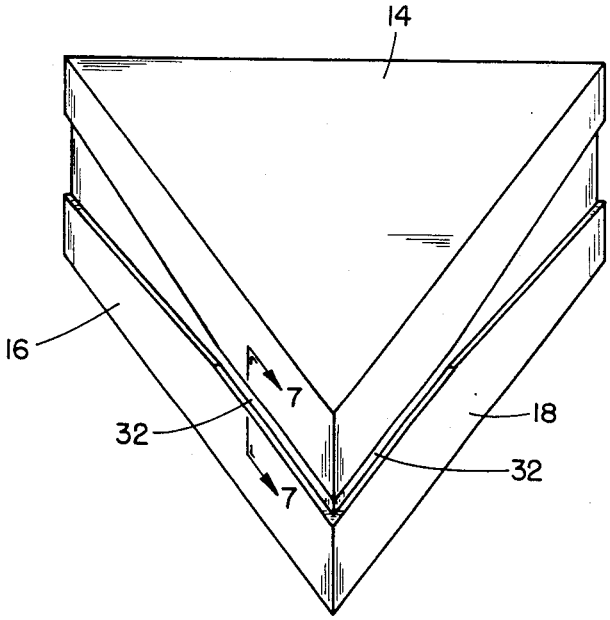
FIG. 6 schematically illustrates a perspective view of the aligner block for the fastener elements on the film web.
Figure 2:
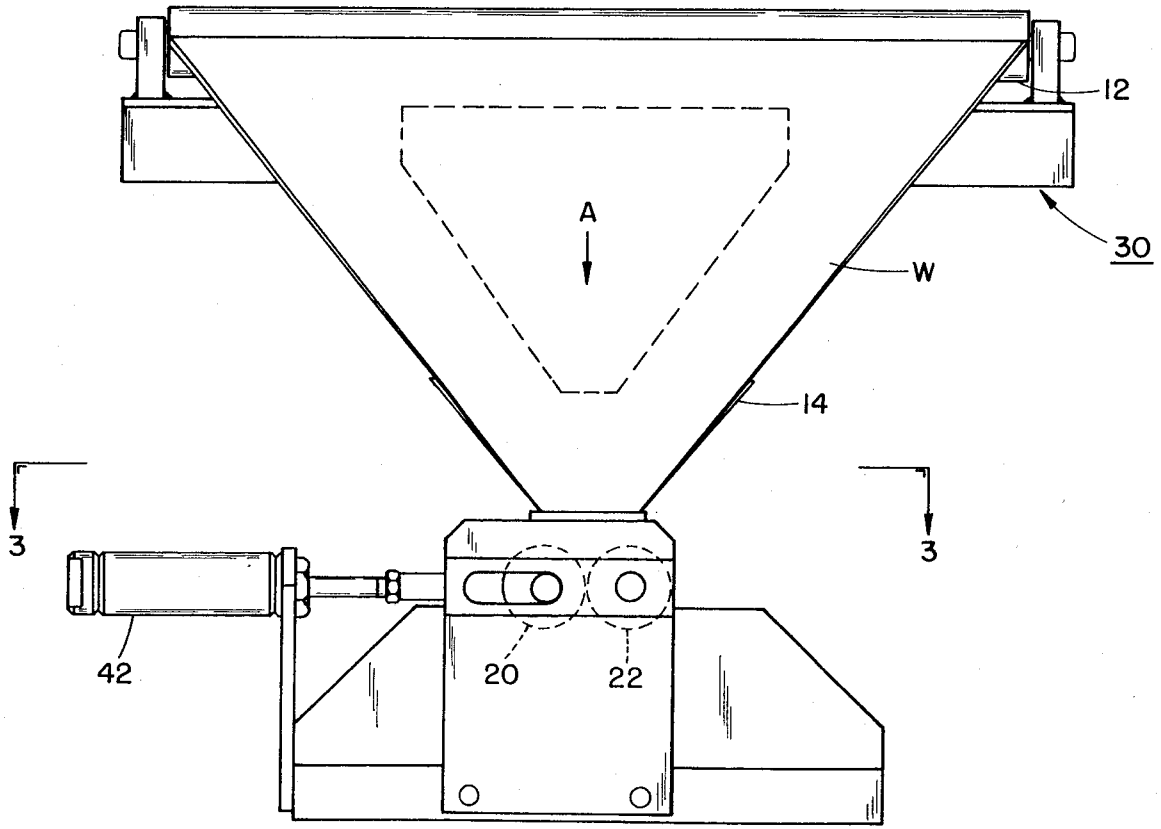
FIG. 2 illustrates a side elevational view of the web folding device including the aligning block and nip rolls for the fastener elements.
Figure 3:
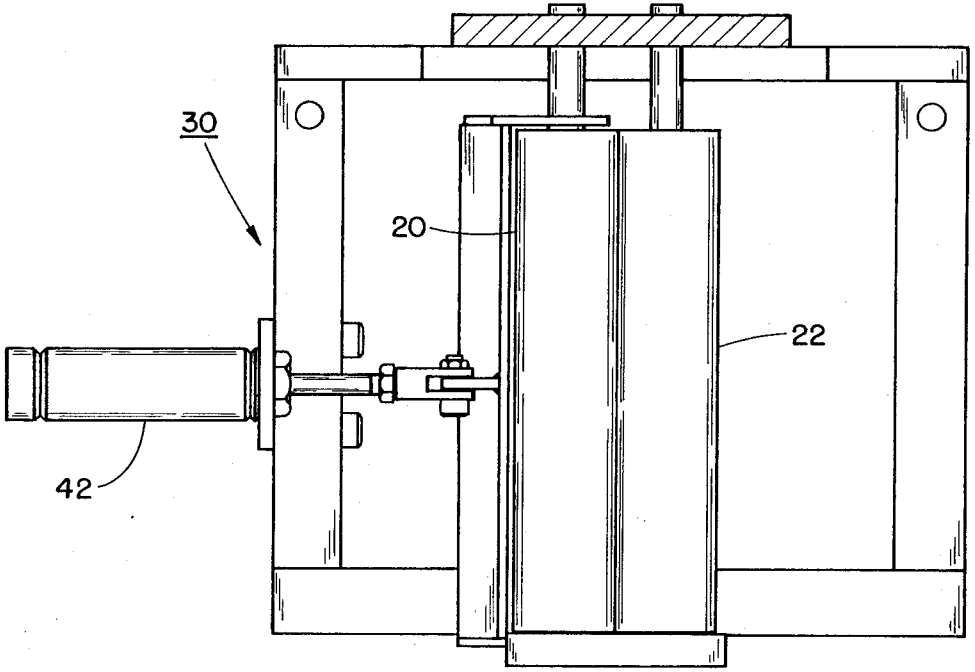
FIG. 3 illustrates a sectional view taken along line 3—3 in FIG. 2.

As is clearly illustrated in FIG. 6 of the drawings, the inlet end of each groove 32 towards the upper edge of each surface 16, 18 is widened in an outward taper in order to facilitate the ready introduction of the fastener elements F', F'' into its associated groove 32 on the respective surface 16 and 18, and then tapers down in width towards the lower portion of each surface 16, 18 in order to ensure that the fastener elements F' and F'' of both folded film web portions W', W'' are appropriately aligned and superimposed as they reach the lower apex or the juncture of the surfaces 16, 18 of the aligner block 14.

As the folded film web W leaves the lower apex of the triangular aligner block 14, with the fastener elements F', F'' on both portions W', W'' of the folded film web being in an aligned and superimposed position, as shown in FIGS. 8 and 8A, the film is conducted through the bite or nip between the counter-rotating nip rolls 20, 22. Radial pressure is imparted to at least one of the nip rolls 20 or 22, which may be axially displaced relative to its other nip roll, in order to cause that particular nip roll to be biased into contact with the cooperating nip roll; this biasing action then compressing the film web and particularly the profiled fastener elements F', F'', thereby effecting the interengagement between the complementary fastener elements F', F'' on the folded film web W. This compressive biasing force may be imparted to the nip rolls 20, 22 by means of a suitable pressure spring unit 42, or hydraulic cylinder, acting on one or both of the nip rolls 20, 22.

Thereafter, as discussed hereinabove, the folded and flattened film web W, with the fastener elements F', F'' being in an interengaged position, may be conducted towards further processing arrangements (not shown); for instance, a seal forming station for producing plastic bags or the like from the film web.

From the foregoing, it is readily apparent that the invention is directed a relatively simple and efficient device and method for folding film webs and aligning and superimposing fastener elements on the webs to provide for the rapid and accurate interengagement of the fastener elements.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed and as hereinafter claimed.

What is claimed is:

1. A method of folding a layflat web of a thermoplastic film material for aligning, superimposing and interengaging continuous complementary interengageable profiled fastener elements thereon extending in parallel spaced relationship in the longitudinal direction of said film web; comprising advancing said web; folding said web into surface portions contacting the opposite surfaces of a triangular folding block, said opposite surfaces converging in the direction of advancement of said web and having grooves formed therein for receiving the respective fastener elements and extending in the direction of advance of said web; guiding said fastener elements within said respective grooves for aligning and superimposing said fastener elements upon leaving said folding block; concurrently biasing said complementary profiled fastener members into surface contact with said opposite surfaces on said folding block surfaces to maintain said fastener elements in the respective grooves in said block surfaces during advance of said web along said surfaces; and imparting pressure to said aligned and superimposed complementary fastener elements by conducting said aligned and superimposed complementary profiled fastener elements through the bite between two counter-rotatable nip rolls after leaving said folding block to cause said fastener elements to interengage into a mutually latched position.

2. A method as claimed in claim 1, wherein each of said opposite block surfaces has a clamping plate arranged in closely spaced relationship therewith and extending over said grooves defining a narrow gap comprising advancing said web through said gap, said clamping plate biasing said web surface portions toward the associated block surfaces.

3. A method as claimed in claim 2, said gap having a width preventing egress of said complementary profiled fastener elements from the grooves in said folding block surfaces into said gap while permitting passage of said film web through said gap.

4. A method as claimed in claim 1, comprising resiliently biasing said nip rolls towards each other to interengage said complementary profiled fastener elements.

5. A device for folding an advancing layflat web of a thermoplastic film material and aligning continuous complementary profiled fastener elements thereon extending in parallel spaced relationship in the longitudinal direction of said film web; including a triangular folding block having opposite planar surfaces converging in the direction of advance of said folded web, and continuous grooves in said opposite surfaces of said folding block extending in the direction of web advance; means for advancing said web into a folding condition into surface contact with said opposite block surfaces, said profiled fastener elements being guided within said grooves during the advance of said film web along said opposite surfaces for alignment and superposition thereof at the juncture of said opposite surfaces of said folding block; means fastened to the opposite surfaces of said block for maintaining each of said complementary fastener elements in an associated one of said grooves in the surfaces of said folding block; and biasing means including two counter-rotatable nip rolls having said web advancing through the bite therebetween being arranged downstream of the juncture of said block surfaces for pressing said superimposed fastener elements into latching engagement with each other.

6. A device as claimed in claim 5, said means for maintaining said film web in contact with said block surfaces comprising clamping plates arranged in closely spaced relationship with each said respective block surface, the clamping plate surface facing the block surface defining a narrow gap to define a passageway for said film web therebetween.

7. A device as claimed in claim 6, said gap having a width preventing egress of said complementary profiled fastener elements from the associated grooves in said folding block surfaces while facilitating passage of said film web through said gap.

8. A device as claimed in claim 5, comprising means for resiliently biasing said nip rolls towards each other for imparting latching pressure to said superimposed profiled fastener elements.

* * * * *